US006285979B1

(12) United States Patent
Ginzburg et al.

(10) Patent No.: US 6,285,979 B1
(45) Date of Patent: Sep. 4, 2001

(54) PHONEME ANALYZER

(75) Inventors: Boris Ginzburg, Migdal Ha'Emek; Barak Dar, Haifa, both of (IL)

(73) Assignee: AVR Communications Ltd., Migdal Ha'Emek (IS)

( * ) Notice: Subject to any disclaimer, the term of this patent is extended or adjusted under 35 U.S.C. 154(b) by 0 days.

(21) Appl. No.: 09/255,591

(22) Filed: Feb. 22, 1999

Related U.S. Application Data

(60) Provisional application No. 60/079,730, filed on Mar. 27, 1998.

(51) Int. Cl.[7] ..... G10L 11/00

(52) U.S. Cl. ..... 704/208; 704/209; 704/214; 704/271; 704/213

(58) Field of Search ..... 704/209, 210, 704/211, 213, 214, 208, 206, 271

(56) References Cited

U.S. PATENT DOCUMENTS 5,276,765 * 1/1994 Freeman et al. ..... 395/2
5,623,609 * 4/1997 Kaye et al. ..... 704/254
6,006,175 * 12/1999 Holzrichter ..... 704/208

* cited by examiner

*Primary Examiner*—William Korzuch
*Assistant Examiner*—Susan McFadden
(74) *Attorney, Agent, or Firm*—Herbert Dubno

(57) ABSTRACT

Phoneme analysis is carried out in real time by detecting a voiced component in the range of 200 Hz to 1 KHz and simultaneously detecting voiceless components having frequencies greater than about 2.4 KHz and greater than about 3.4 KHz, respectively, to produce respective outputs which are logically combined to produce two-bit logic signals which can be used to control a speech processing device.

12 Claims, 5 Drawing Sheets

PHONEME ANALYZER

CROSS REFERENCE TO RELATED APPLICATION

This application is related to of copending provisional application 60/079,730 filed Mar. 27, 1998.

FIELD OF THE INVENTION

Our present invention relates to a phoneme analyzer and, more particularly, to a phoneme analysis method which operates in real time and is capable of analyzing speech. Specifically, the invention is intended to detect speech sounds in real time, and to distinguish voiced speech sounds from unvoiced or voiceless speech sounds. The information obtained by such analysis can be used to enhance the speech signal in hearing aids for the hard of hearing, can be used in conjunction with noise cancelling algorithms to suppress noise in speech reproduction systems, to improve the quality of speech-to-text computer translations, and to make speech operated systems more precise with respect to the response.

The invention also relates to a method facilitating fast detection of selected speech sounds in noisy real life acoustic environments and to phoneme analysis which can be implemented using very low power electrical circuitry.

BACKGROUND OF THE INVENTION

The typical structure of speech is Vowel-Consonant-Vowel (VCV) or Consonant-Vowel-Consonant (CVC). All vowels are produced by voiced sounds, although many consonants are produced with nonvoiced or voiceless (VL) sounds. The energy peaks in voiced sounds are predominantly in lower frequencies below 3 KHz. In voiceless sounds the energy peaks are predominantly in higher frequencies above 3 KHz. There is typically more energy in voiced sounds than in voiceless sounds.

One known method to discriminate voiced from voiceless sounds is to analyze the zero-crossing frequency of speech. However this method itself cannot provide reliable detection in noisy environments. Also this method does not work well for females and children who have higher pitched voices.

For example some vowels, such as /i/, /ea/ and /e/, have higher energy peaks (second and third formats) and may generate high zero crossing frequencies. Table 1. shows an average of the first and second formants of such American vowels for male, female and child voices:

TABLE 1

| Vowel | heat | hit | when | pay |
|---|---|---|---|---|
| 1st Formant | | | | |
| Male | 270 | 390 | 530 | 660 |
| Female | 310 | 430 | 610 | 860 |
| Child | 370 | 530 | 690 | 1010 |
| 2nd Formant | | | | |
| Male | 2290 | 1990 | 1840 | 1720 |
| Female | 2790 | 2480 | 2330 | 2050 |
| Child | 3200 | 2730 | 2610 | 2320 |

In the presence of noise (typically in lower frequencies), the zero crossing of voiceless consonants may be "pulled" down to lower frequencies.

OBJECTS OF THE INVENTION

It is the principal object of the present invention to provide a real time method of analyzing speech whereby drawbacks of earlier systems can be avoided.

Another object of this invention is to provide a method of detecting speech sounds in real time and to discriminate voiced speech from voiceless speech sounds, particularly to enhance signal processing in hearing aids, noise cancelling circuitry, speech-to-text computer applications and speech operated systems generally.

A further object of the invention is to provide a phoneme analyzer which can be realized with low power electric circuitry and is capable of fast detection of speech sounds in noisy environments.

SUMMARY OF THE INVENTION

These objects and others which will become apparent hereinafter are attained, in accordance with the invention in a real time method of analyzing speech which comprises the steps of:

(a) obtaining a speech signal containing ambient noise in addition to voiced vowel sounds, low frequency voiceless sounds and high frequency voiceless sounds;

(b) detecting in the speech signal a voiced component having a frequency in a range of 200 Hz to about 1 KHz and generating a first output when the energy in the frequency range of 200 Hz to about 1 KHz is present in the speech signal;

(c) simultaneously detecting in the speech signal a voiceless component having a frequency greater than about 2.4 KHz and generating a second output when the frequency greater than about 2.4 KHz is present in the speech signal;

(d) simultaneously detecting in the speech signal a voiceless component having a frequency greater than about 3.4 KHz and generating a third output when the frequency greater than about 3.4 KHz is present in the speech signal;

(e) logically combining the first, second and third outputs to produce two-bit logic signals representing high-frequency voiceless sound, lower-frequency voiceless sound, selected vowel sounds and other voiced sounds; and (f) controlling a speech processing device with the two-bit logic signals.

As will be described in greater detail hereinafter, step (c) is carried out preferably by analyzing for a zero crossing frequency above 4.8 KHz and in step (d) the speech signal is analyzed for a zero crossing frequency above 6.8 KHz, it being understood that the zero crossing frequency is twice the signal frequency.

According to a feature of the invention in step (b), an energy level is measured in the 200 to 1000 Hz band of the speech signal and the current measured energy level should be compared with energy level established as the base level which is measured during interval in which there is no voiced component in speech signal and only ambient noise and high frequency unvoiced speech sounds occur representing noise in the speech signal.

More particularly, the purpose of the invention is to provide reliable discrimination between the following sounds:

a) high frequency voiceless sounds such as fricatives (/s/ and /sh/) with a frequency predominantly greater than 3.4 KHz (or zero crossing frequency predominantly greater than 6.8 KHz).

b) lower frequency voiceless sounds (such as fricatives (/s/ and /sh/) in a noisy environment with a frequency predominantly greater than 2.4 KHz (or zero crossing frequency predominantly greater than 4.8 KHz).

c) high frequency vowels such as /i/, /ea/, where the predominant frequency in a female voice is around 2.7 KHz but does not exceed 3.3 KHz (even in the case of a child).

d) all other vowels and voiced sounds including nasal.

The advantage of the analysis method described herein, is its operation in the frequency domain without dependency on the amplitude. Typically the envelope of the speech has higher levels for vowels, than for voiceless consonants (or the ambient noise). The difference can be further enhanced for the vowels, /i/ /ee/ by means of band pass filter in the band 200–1000 Hz. This is because most voiceless sounds will have most of their energy above 2 KHz and the ambient noise is typically concentrated below 500 KHz. The first formant of the /i/ is around 300–400 KHz for male voice and 400–600 Hz for female voice.

The analyzer comprises a stage to detect energy in restricted frequency bands and three separate detectors of frequency detectors of frequency thresholds for:

| | |
|---|---|
| Voiceless (VL) | detects crossing a threshold of 3.4 KHz; |
| e or VL | detects crossing a threshold of 2.4 KHz; and |
| Voiced | detects voiced component via the speech envelope in the band 200–1000 KHz. |

The logic outputs of the three detectors are combined into two-bit logic code expressing the four possible results of the phoneme analysis.

When detecting the energy of the voiced component in the restricted frequency band, the ambient noise (especially multi-talker speech noise), may interfere with the measurement by creating fluctuations of the energy in this band unrelated to the speech envelope which typically fluctuates between vowels (increased) and voiceless consonants (reduced).

In its apparatus aspects, the invention can comprise a phoneme analyzer provided with means for obtaining a speech signal containing ambient noise in addition to voiced vowel sounds, low frequency voiceless sounds and high frequency voiceless sounds, means connected to the input means for detecting a voiced component having a frequency in the range of 200 Hz to about 1 KHz and generating a first output when energy in the frequency range of 200 Hz and 1 KHz is present in the speech signal, means also connected to the input for simultaneously detecting in the speech signal a voiceless component having a frequency greater than about 2.4 KHz for generating a second output, e.g. in the form of a zero crossing detector responding at a zero cross frequency above 4.8 KHz, means also connected to the input means for detecting a voiceless component having a frequency greater than about 3.4 KHz for generating the third output (preferably also a zero crossing detector responding at about 6.8 KHz), logic circuitry for combining the first, second and third outputs to provide the two-bit signals mentioned previously, and a means for controlling a speech processing device connected to the logic circuitry and responsive to the two-bit logic signals.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
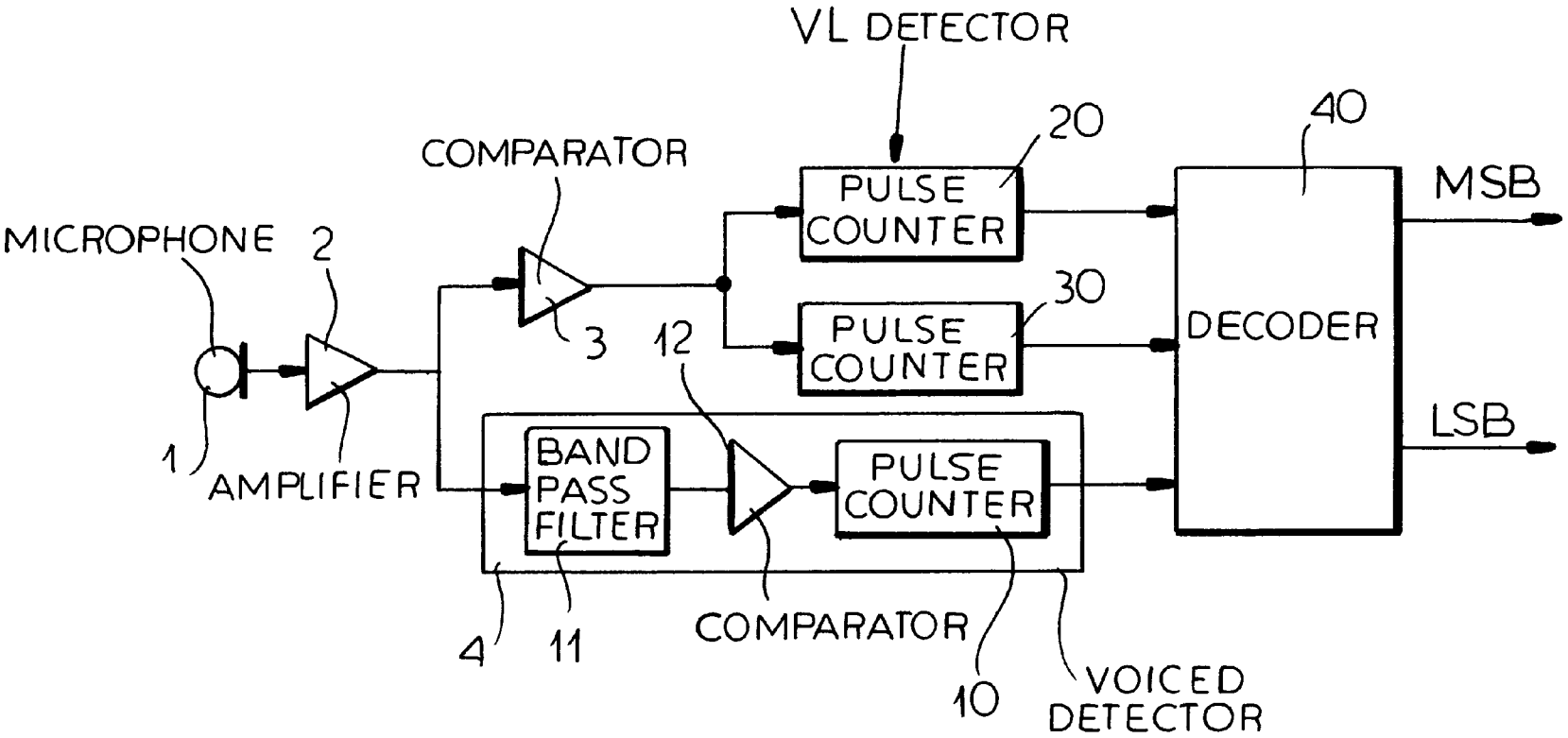
FIG. 1 is a circuit diagram of a phoneme analyzer in accordance with a first embodiment of the invention.

FIG. 1 shows that implementation of the invention is based on a combination of analog and logic signals. The speech signal is picked up by a microphone 1 (such as Knowles Electronics EK3024) and amplified by amplifier 2 (such as Genum Corporation's LX509). The signal is then fed into the voiced detector 4 where it is passed via 4th order band pass filter 11 with 200 Hz 4th order high pass filter (HPF) and 1000 Hz 4th order low pass filter (LPF), into a comparator 12 (such as Texas Instrument's TLC3702). Comparator 12 transforms the analog speech signal into square waves. A pulse counting circuit 10 counts the frequency of the pulses and compares it to a window between 200 Hz and 1000 Hz. If the frequency falls within the window, the output is a "logic 1" otherwise the result is a "logic 0".

The signal from amplifier 2 is also fed into comparator 3 and to "voiceless detector" comprising pulse counting circuit 20 set to provide a value of "logic 1" when the frequency of the pulses exceed 3.4 KHz and a value of "logic 0" if below this value. The signal from comparator 3 is also fed into "/e/" or "voiceless" detector comprising pulse counting circuit 30 set to provide a value of "logic 1" when the frequency of the pulses exceed 2.4 KHz and a value of "logic 0" if below this value.

The logic signals from pulse counting circuit 10, pulse counting circuit 20 and pulse counting circuit 30 are fed into decoder 40 which combines the logic outputs of the frequency counting devices into a two-bit logic code expressing the four possible results of the phoneme analysis.

Decoder 40 can be implemented by means of combining NAND, OR, AND and Inverting gates or by using a micro controller/processor with a decoding table corresponding with the analysis result in ROM (read only memory).

Decoder 40 transforms a 3 bit code produced by the three counting circuits into the following two-bit code: If pulse counting circuit 20 produces an output of "logic 1" then by definition, pulse counting circuit 30 also produces an output of "logic 1". In such a case, the logic output from detector 4 is ignored and the result is "logic 11" indicating high frequency voiceless sound. If pulse counting circuit 20 produces an output of "logic 0" and pulse counting circuit 30 produces an output of "logic 1" and detector 4 produces an output of "logic 0" then the result is "logic 10" indicating lower frequency voiceless sound. If pulse counting circuit 20 produces an output of "logic 0" and pulse counting circuit 30 produces an output of "logic 1" and detector 4 produces an output of "logic 1" then the result is "logic 01" indicating the vowels /ea/ or /I/. If pulsing counting circuit 20 produces an output of "logic 0" and pulse counting circuit 30 produces an output of "logic 0" then regardless of the output from detector 4 the result is "logic 00" indicating other voiced sounds.

It should be apparent from the above description that the combination of BPF 11, comparator 12 and pulse counting window 10, overcomes the adverse affects of poor signal to noise ratio on the reliability of the analysis. Band pass filter 11 improves the signal-to-noise ratio by restricting the bandwidth to 200–1000 Hz.

Comparator 12 can be set to have a threshold above the noise level in the 200–1000 Hz. Thus, during voiceless sound (when there is no voiced component in the speech signal), noise is prevented from passing on to the pulse counting stage. However, very intense signals outside the band of band pass filter 11 (i.e., lower than 200 Hz or greater than 1000 Hz) and above the threshold of comparator 12, may still trigger the comparator. The pulse counting window increases the reliability of the analysis by ignoring such signals and preventing a situation in which ambient noise will interfere with the detection of voiceless speech sounds.

Figure 2A:
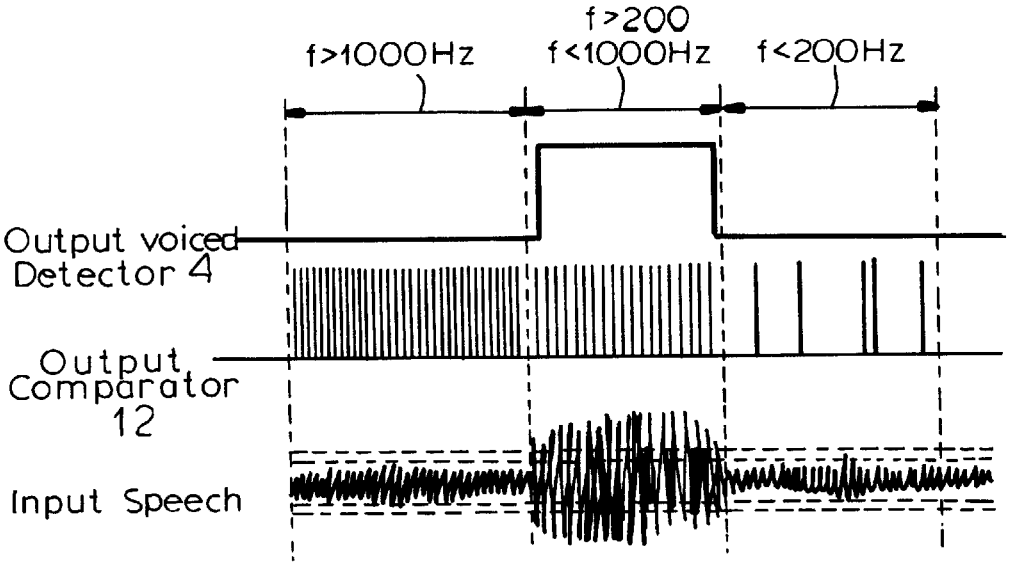
FIGS. 2*a* and 2*b* are graphs illustrating the method of the invention.

FIG. 2*a* shows the input signal and the output of comparator 12 and the output from the voiced detector.

Figure 2B:
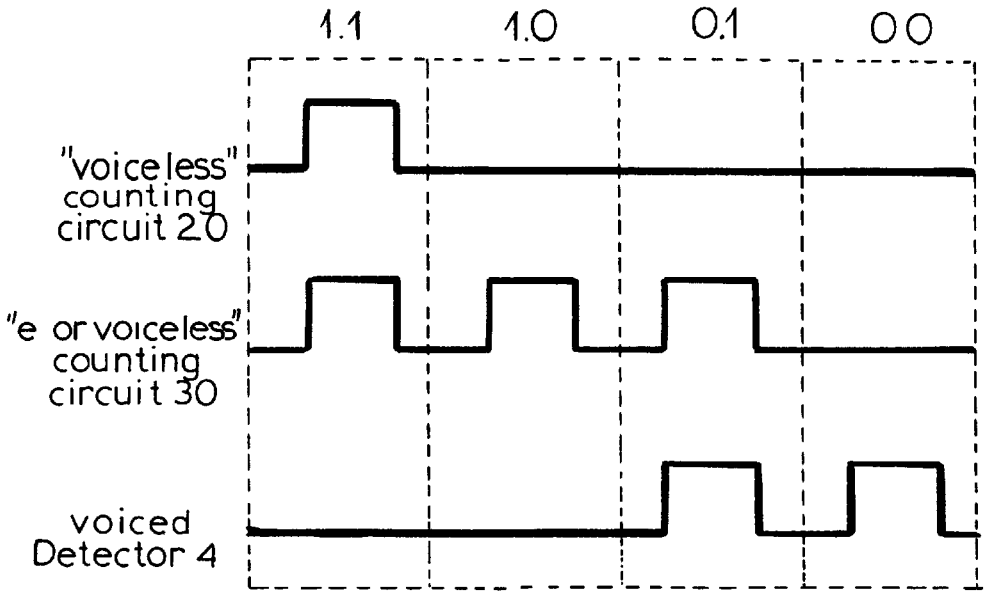

FIG. 2*b* shows the results of a decoder 40 which combines the outputs of the frequency counting devices of the detectors into two-bit logic signals:

| | |
|---|---|
| 11 = HVL | for high frequency voiceless sound |
| 10 = LVL | for lower frequency voiceless |
| 01 = E | for/ea/or /i/vowels |
| 00 = V | other voiced sounds |

Figure 3A:
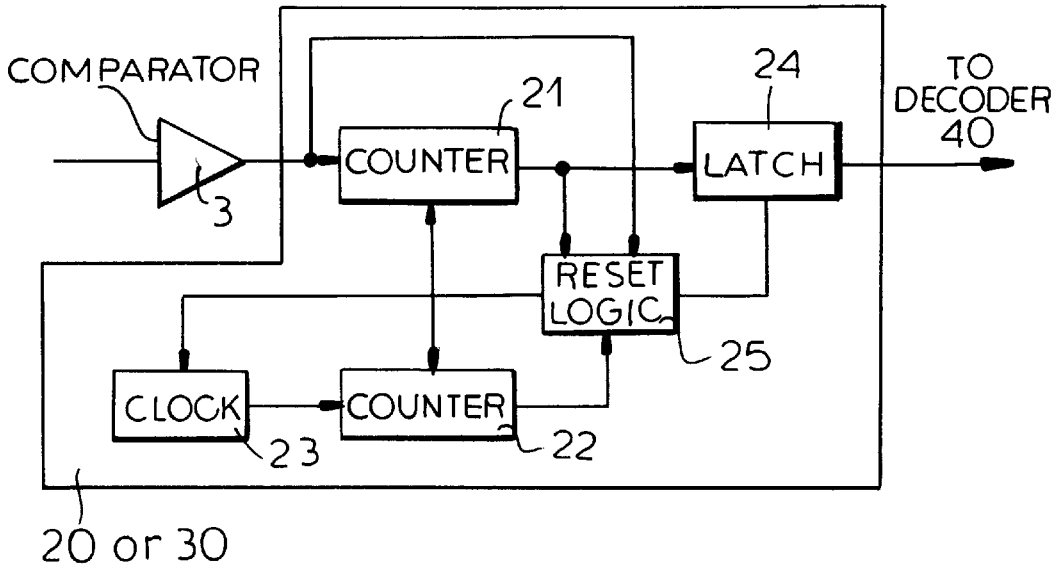
FIG. 3*a* and 3*b* are block diagrams of portions of a phoneme analyzer circuit as used in FIG. 1.

FIG. 3*a* shows a typical pulse counting circuit used in detectors 10, 20, and 30. The signal from comparator 3 (or 12) is fed into 5-bit counter 21 (for example a 5-bit counter can be made using two sequential MC 14161 4 bit presetable binary counters by Motorola), which counts "n" cycles of the signal. Reference 5-bit counter 22 counts the same number "n" cycles produced by reference clock generator 23. The cycle duration of clock generator 23 (Tr) defines the frequency threshold (1/Tr) of the detector. Because voiced sounds are characterized by low frequencies, pulse counting circuit 10 has the longest reference clock cycle, typically between 1.25 mS. and 5 mS. (see description of FIG. 3*b*). Voiceless sounds are characterized by high frequencies therefore pulse counting circuit 20 has the shortest reference clock cycle, typically 330 $\mu$S.

If counter 21 finishes counting "n" cycles, it applies logic "1" to latch 24 (latch 24 is a single R–S flip-flop latch such as MC14013 by Motorola) and to the input of reset logic 25 (reset logic 25 is a combination of NAND and NOR gates and flip-flops). If counter 22 finishes counting "n" cycles, it applies logic "1" into the input of reset logic 25 and resets latch 24. Thus, in the case where the speech signal frequency is higher than the detector's threshold, the signal from the comparator has a higher frequency than reference clock generator 23. Therefore counter 21 will finish counting "n" cycles before counter 22. It will set logic "1" at the output of latch 24 and will reset both counters and Reference Clock Generator 23 via reset logic 25.

To provide synchronization and continuous operation, the next pulse from the comparator, after the reset, will start a new analysis cycle via reset logic 25. In case the speech signal frequency is lower than the detector's threshold, the signal from the comparator has a lower frequency than reference clock generator 23. Therefore counter 22 will finish counting "n" cycles before counter 21. It will reset "logic 0" at the output of latch 24, and will reset both counters and reference clock generator 23 via reset logic 25. To provide synchronization and continuous operation, the next pulse from the comparator, after the reset, will start a new analysis cycle via reset logic 25.

The total measurement time of reference counter 22 should be significantly shorter than the typical duration of speech phoneme (50–100 mS.) but long enough for accurate measurement. Thus the measurement time is typically 2–10 mS. The number of cycles "n" used for the detection, is a function of the frequency of the threshold. In the case of pulse counting circuit 10, intended to detect voiced sounds which are characterized by low frequencies, "n" is typically n=3 and in the case of pulse counting circuit 20, intended to detect voiceless sounds which are characterized by high frequencies, "n" is typically n=20.

Figure 3B:
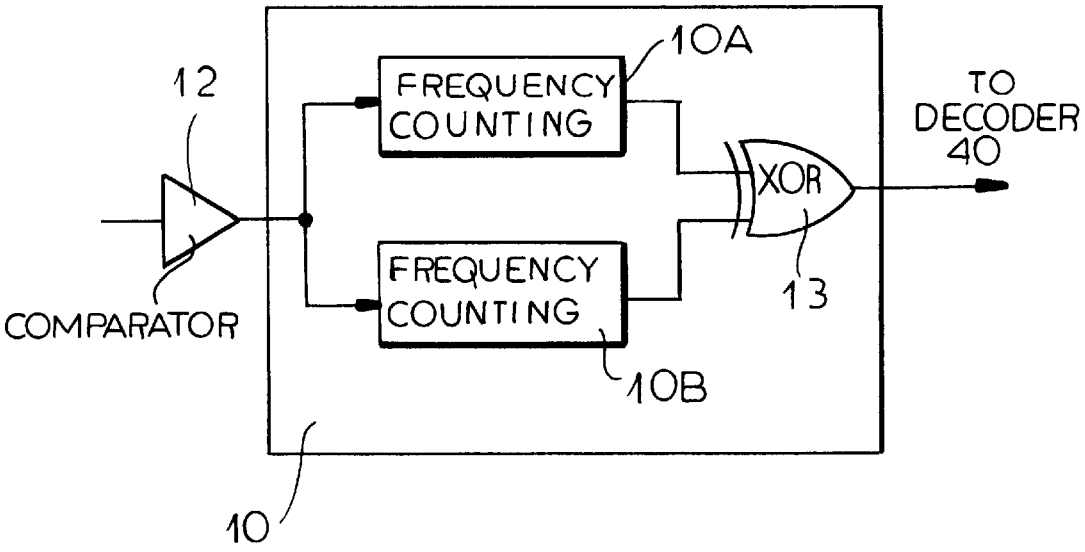

FIG. 3*b* shows a typical implementation of pulse counting window 10 used in voiced detector 4. Two frequency counting circuits 10A and 10B, identical to the circuit described in FIG. 3*a,* are set to detect threshold crossing of 200 Hz and 1000 Hz respectively. An Exclusive-or (XOR) circuit 13 combines the outputs of frequency counting circuits 10A and 10B to detect that the signal is present in the window between 200 Hz and 1000 Hz. If frequency counting circuits 10A produces an output of "logic 1" and frequency counting circuits 10B produces an output of "logic 0", then the signal is in the "window" and XOR 13 produces a "logic 1". If both frequency counting circuits produce an output of "logic 0" the signal is lower than the window and XOR 13 produces a "logic 0". If both frequency counting circuits produce an output of "logic 1", the signal is higher than the window and XOR 13 produces a "logic 0".

Figure 4:
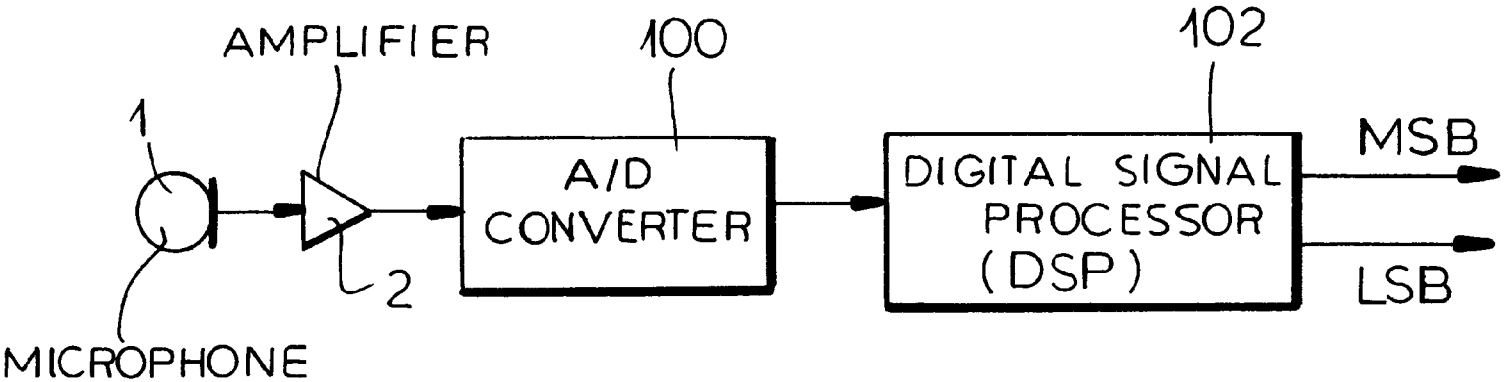
FIG. 4 is a diagram of another phoneme analyzer circuit according to the invention.

FIG. 4 shows another implementation of the invention based on converting the analog speech signals into digital signals. The speech signal is picked up by a microphone 1, amplified by amplifier 2 and converted into a digital signal via analog to digital converter 100 (such as MAX1240 12-bit ADC by Maxim) at a sampling rate of 20 KHz or greater. The signal is then fed into digital signal processor DSP 102 (such as ADSP2105 by Analog Devices).

Figure 5:
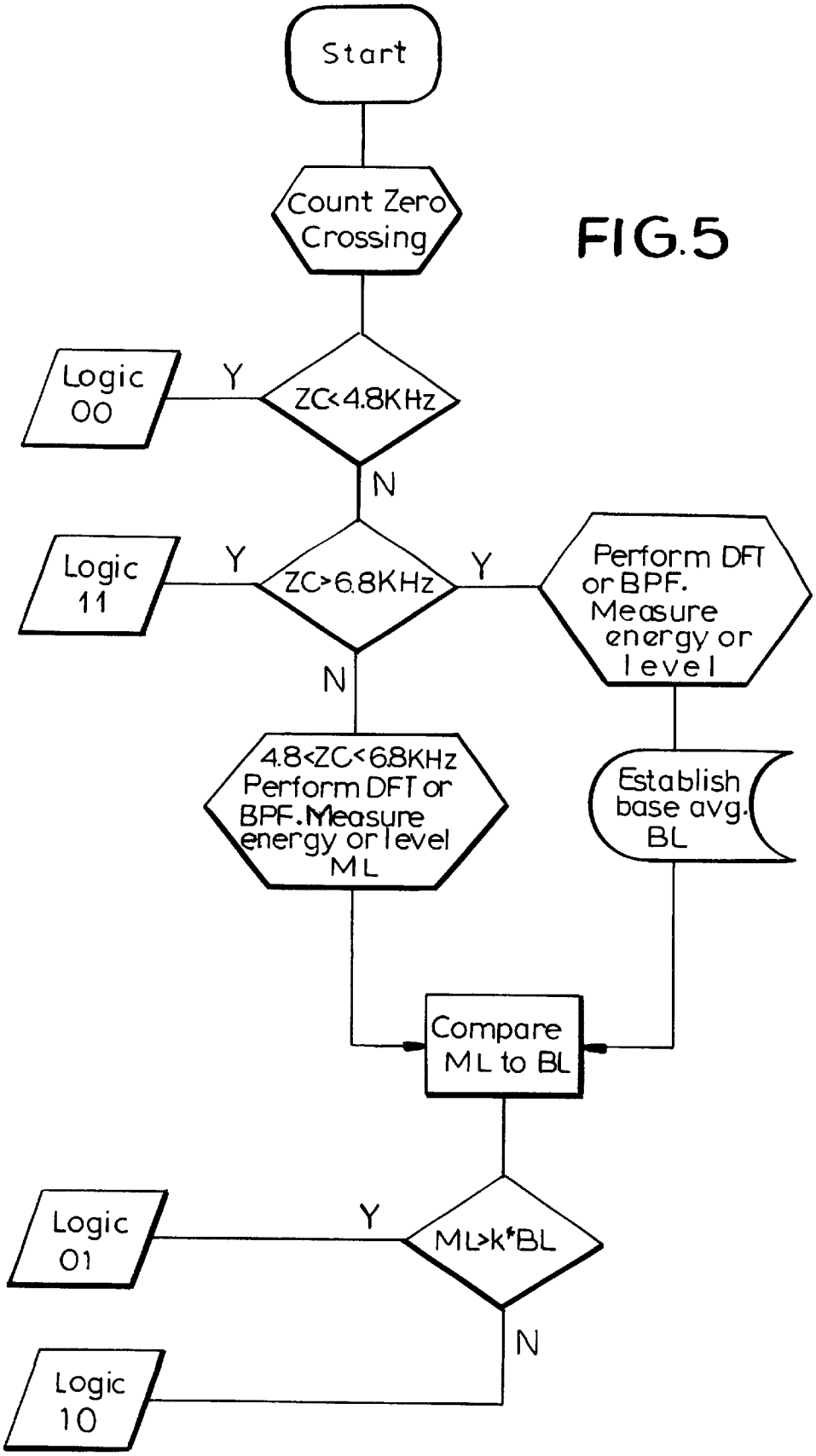
FIG. 5 is an algorithm for the digital signal processor of FIG. 4.

The phoneme analyzer algorithm implemented by DSP 102 is shown in the flow chart of FIG. 5.

DSP 102 performs a digital zero crossing analysis. The zero crossing of the input is counted in each non-overlapping frame of data points. The count is divided by the length of the frame. The frequency values are linearly interpolated to the result. If the zero crossing is less than 4.8 KHz (the input speech signal frequency is respectively lower than 2.4 KHz), DSP 102 produces a two-bit logic output of "logic 00" indicating voiced sound. If the zero crossing is greater than 6.8 KHz (the input speech signal frequency is respectively higher than 3.4 KHz), DSP 102 produces a two-bit logic output of "logic 11" indicating voiceless sound and measures the energy or level in the band 200 Hz and 1000 Hz.

During voiceless detection, the dominant sound is not voiced. Therefore the energy in the band 200–1000 Hz at this point in time, reflects the ambient noise. The averaged value in the 200–1000 KHz band during periods of "voiceless" can be calculated and updated periodically by DSP 102 and used as "base level" (BL) representing a long term average of the ambient noise in this band. DSP 102 can perform a measurement of the energy in the band 200–1000 Hz by using a Discrete Fourier Transform (DFT) at a single frequency using only one coefficient to multiply and accumulate the stream of data points and provide a result at the end of each consecutive window. The center frequency must be around 500 Hz and with a band width of 500–700 Hz. The DFT result reflects the energy in the band. For example for an input frequency bandwidth of 8 KHz (Fmax), the DFT requires only 32 data points to provide a resolution of 500

Hz (DFT resolution=2×FMax/number of points) which results in a band between 250 Hz to 750 Hz. This method is efficient because this calculation requires minimal operative data RAM (random access memory) and only one coefficient and thus can be performed with very low power consumption.

If the zero crossing is greater than 4.8 KHz and less than 6.8 KHz (the input speech signal frequency is respectively higher than 2.4 KHz and lower than 3.4 KHz), DSP 102 measures the energy in the band 200 Hz to 1000 Hz (marked ML) and compares to the "base level" (BL) calculated during periods of previous voiceless sounds. If ML>k*BL then the sound is voiced. A reliability coefficient "k" is used to define the ratio between ML and BL. Typically "k" has a value between 3 and 6 reflecting an increase of approximately 10 dB–16 dB in the speech envelop during vowel production. If ML is substantially above BL, then the sound is voiced (probably a vowel such as /i/ or /ea/) and DSP 102 produces a two-bit logic output of "logic 01". If not, it is probably a voiceless sound and DSP 102 produces a two-bit logic output of "logic 10".

It should be apparent from the description of FIG. 4, that the use of Discrete Fourier Transform (DFT) to measure the energy in the range 200–1000 Hz excludes energy from other bands from being measured. Furthermore, the "base level" is established only during high frequency voiceless speech sounds (when there is no voiced component in the speech signal) and as a result the "base level" reflects the average ambient noise level in this band. The energy in this band is then measured when the result is zero crossing measurement is insufficient to determine if the speech signal is /ee/ or a voiceless phoneme and compared to the "base level". Thus even in a noisy environment, the additional energy generated by the vowel /ee/ will be greater than the energy marked as "base level". Table 2 shows typical analysis functions and results.

TABLE 2

| Result | HVL > 3.2KHz (ZC > 6.8 KHz) | LVL > 2.4KHz (ZC > 4.8 KHz) | Engery in 200–1000 Hz band | DFT or BPF measurement procedure |
|---|---|---|---|---|
| Other voiced | 0 | 0 | N/A | Do nothing |
| Voiced/ee/ | 0 | 1 | Higher than base level | Compare DFT band to base value |
| Voiceless | 0 | 1 | lower than base level | Compare DFT band to base value |
| Voiceless | 1 | 1 | N/A | Measure DFT Band and establish base value |

The result can be used in a variety of ways. For exampler: In a hearing aid, the dynamic signal processing can be applied based on the analysis results:

a. Voiceless signals can be transposed to lower frequencies.

b. Voiceless signals can be emphasized by additional amplification c. Voiceless signals can be filtered to reduce noise.

d. Lower frequency voiceless signals such as /t/ and /k/ may be too short (in duration) to be perceived by a hearing impaired person suffering temporal disorders. When such sounds are detected by the invention, their duration (the duration in which the respective 2-bit code is present) can be measured and can be prolonged to longer periods of time by means of continuous sampling from data memory.

e. For a person with little or no hearing in high frequencies (hearing up to 1 KHz) selected vowel sounds such as /ee/ or /e/ can be confused with other sounds such as /oo/ or /u/ because the spectral shape of such sounds is essentially the same in lower frequencies and the differences between them occur only in higher frequencies. By applying special signal processing such as filtering, amplification and frequency transposition, discrimination of /I/ and /u/ can be improved.

f. Background noise from multi-talker situations (i.e., "cocktail party noise) typically concentrates between 200–1000 Hz. It is very difficult to distinguish such noise from a speech of a desired speaker because it originates in speech as well. By establishing the (noise) base level in the band 200–1000 Hz during reliable detection of voiceless speech sounds produced by the desired speaker, it is possible to distinguish between noise and speaker's levels. Improving the signal to noise of the speech signal, noise reduction can be achieved by means of reducing the gain in the band 200–1000 Hz of offset (normalize) the average noise level or by applying suitable filtering in this band.

In portable communication equipment:

a. The audio bandwidth is typically around 3 KHz. This reduces audibility of high frequency sounds such as voiceless consonants. By detecting such sounds it is possible to compress the frequency band (transpose to lower frequencies) of the transmitting device and respectively expand the frequency band (transpose back to original frequencies) of the receiving device. This will allow transmission of wider audio bandwidth over the standard limited bandwidth.

b. Furthermore, portable communications equipment is typically restricted to narrow radio frequency band requiring dynamic range compression and expansion. Since voiceless consonants are substantially less intense than vowels, the ability to detect voiceless consonants may permit further reduction of dynamic range without impairing the intelligibility of the speech.

c. Noise reduction can be performed as per above in the hearing aid application.

In speech-to-text computer programs:

a. Detection of specific phonemes and particularly voiceless consonants may increase the translation speed and reliability. This is because it will provide specific information at the phoneme level, which combined with the known structure of speech to vowel-consonant-vowel (VCV), or consonant-vowel-consonant (CVC) will narrow the possibilities of words matching the speech.

b. Noise is very destructive to such speech to text programs. Noise reduction can be performed as per above in the hearing aid application.

We claim:

1. A real-time method of analyzing speech for phonemes contained therein comprising the steps of:

(a) obtaining a speech signal containing voiced vowel sounds, low frequency voiceless sounds and high frequency voiceless sounds;

(b) detecting in said speech signal a voiced component having a frequency in a range of 200 Hz to about 1 KHz and generating a first output when said frequency in said range of 200 Hz to about 1 KHz is present in said speech signal;

(c) simultaneously detecting in said speech signal a voiceless component having a frequency greater than about 2.4 KHz and generating a second output when said frequency greater than about 2.4 KHz is present in said speech signal;

(d) simultaneously detecting in said speech signal a voiceless component having a frequency greater than about 3.4 KHz and generating a third output when said frequency greater than about 3.4 KHz is present in said speech signal;

(e) logically combining said first, second and third outputs to produce two-bit logic signals representing high-frequency voiceless sound phonemes, lower-frequency voiceless sound phonemes, selected vowel sound and other voiced sound phonemes; and (f) controlling a speech processing device with said two-bit logic signals.

2. The real-time method of analyzing speech defined in claim 1 wherein in step (c) said speech signal is analyzed for a zero-crossing frequency above 4.8 KHz.

3. The real-time method of analyzing speech defined in claim 1 wherein in step (d) said speech signal is analyzed for a zero-crossing frequency above 6.8 KHz.

4. The real-time method of analyzing speech defined in claim 1 wherein in step (b) an energy level is measured in the 200 to 1000 Hz band of said speech signal and the current measured energy level should be compared with energy level established as base level which is measured during interval in which there is no voiced component in speech signal and only ambient noise and high-frequency unvoiced speech sounds occur representing noise in the speech signal.

5. The real-time method of analyzing speech defined in claim 1, further comprising the step of enhancing audibility of specific sounds in a hearing aid with said two-bit logic signals.

6. The real-time method of analyzing speech defined in claim 1, further comprising the step modifying compression and reducing bandwidth in portable communications equipment with said two-bit logic signals.

7. The real-time method of analyzing speech defined in claim 1, further comprising the step of enhancing automatic speech-to-text translation with said two-bit signals.

8. The real-time method of analyzing speech defined in claim 1, further comprising the step of increasing intelligibility of reproduced sound at low frequencies in sound reproduction using said two-bit signals as an indication for noise measurement.

9. An apparatus for real-time phoneme analysis of speech, said apparatus comprises:

input means for obtaining a speech signal containing voiced vowel sounds, low frequency voiceless sounds and high frequency voiceless sounds;

means connected to said input means for detecting said in said speech signal a voiced component having a frequency in a range of about 200 Hz to about 1 KHz and generating a first output when said frequency in said range of 200 Hz to about 1 KHz is present in said speech signal;

means connected to said input means for simultaneously detecting in said speech signal a voiceless component having a frequency greater than about 3.4 KHz and generating a third output when said frequency greater than about 3.4 KHz is present in said speech signal;

means for logically combining said first, second and third outputs to produce two-bit logic signals representing high-frequency voiceless sound phonemes, lower frequency voiceless sound phonemes, selected vowel sound and other voiced sound phonemes; and means for controlling a speech processing device with said two-bit logic signals.

10. The apparatus defined in claim 9 wherein said means for detecting said voiceless components include counters to count signal pulses having frequencies greater than about 2.4 KHz and greater than about 3.4 KHz respectively and reference clock counters to count reference frequencies 2.4 KHz and 3.4 KHz respectively.

11. The apparatus defined in claim 9 wherein said means for detecting said voiced component includes at least one band pass filter, a comparator and a pulse counter.

12. The apparatus defined in claim 9 wherein said means for obtaining said speech signal comprises an analog/digital converter for digitalizing said speech signal and said means for detecting and said means for logically combining are formed by a digital signal process.

* * * * *